US007555850B2

(12) United States Patent
Park

(10) Patent No.: US 7,555,850 B2
(45) Date of Patent: Jul. 7, 2009

(54) CRAMPON

(76) Inventor: Jung Keuk Park, #301, 514-3(4/4), Oksu-dong, Seongdong-gu, Seoul (KR) 133-100

( * ) Notice: Subject to any disclaimer, the term of this patent is extended or adjusted under 35 U.S.C. 154(b) by 448 days.

(21) Appl. No.: 11/458,351

(22) Filed: Jul. 18, 2006

(65) Prior Publication Data

US 2007/0283596 A1 Dec. 13, 2007

(30) Foreign Application Priority Data

Jun. 13, 2006 (KR) ..... 10-2006-0053091

(51) Int. Cl.
*A43C 15/06* (2006.01)

(52) U.S. Cl. ..... 36/62; 36/7.7

(58) Field of Classification Search ..... 36/62, 36/7.7, 134, 7.6

See application file for complete search history.

(56) References Cited

U.S. PATENT DOCUMENTS 1,757,919 A * 5/1930 Ostrander ..... 36/62
2,313,099 A * 3/1943 Smith ..... 36/62
2,401,891 A * 6/1946 Smith ..... 36/62
2,579,143 A * 12/1951 Steinhelper ..... 36/62
2,862,310 A * 12/1958 Bodnaruk ..... 36/7.6
6,360,455 B1 * 3/2002 Seo ..... 36/61
6,385,865 B1 * 5/2002 Jang et al. ..... 36/61
2004/0150213 A1 * 8/2004 Dodge ..... 280/809
2005/0229434 A1 * 10/2005 Yoo ..... 36/59 R
2007/0283596 A1 * 12/2007 Park ..... 36/62
2008/0263903 A1 * 10/2008 An ..... 36/134

* cited by examiner

*Primary Examiner*—Ted Kavanaugh

(57) ABSTRACT

The present invention relates to a crampon having a movable spike element in the rotation structure for both walking or climbing to improve walking convenience and safety of a user. The crampon according to the present invention comprises a binding bend; a main plate to be mounted to a sole of a climbing shoe; supporting shafts; movable spike elements axially coupled with the supporting shafts; pins fitted into the supporting shafts perpendicularly to the shafts; and rotating locking levers.

4 Claims, 4 Drawing Sheets

CRAMPON

BACKGROUND OF THE INVENTION

1. Field of the Invention

The present invention relates to a crampon, and more particularly to a crampon having a movable spike element in the rotation structure for both walking and climbing to improve walking convenience and safety of a user simultaneously.

2. Discussion of Related Art

In general, crampons are used for preventing slippage of a user when the user walks on an icy or snowy road during mounting climbing in winter time. Such a crampon secures and supports a mountain climbing shoe thereon and includes a main plate having a plurality of movable spike elements at a lower part and a binding band for fixing the main plate under a sole of a climbing shoe.

In other words, the crampon is mounted to the sole of the mountain climbing shoe by coupling both ends of the binding band in a necessary section such as an icy or snowy road, and separated from the mountain climbing shoe by releasing the coupling of the both ends of the binding band in an unnecessary section when climbing a mountain in winter time.

Therefore, the crampon is mounted to the bottom of the mountain climbing shoe according to mountain climbing conditions in winter time for preventing a user from being hurt from a fall or slippage in advance.

The user can determine to use such crampons or not in consideration of mountain climbing conditions before mounting the crampon to his mountain climbing shoes.

The conventional crampons as above have, however, a disadvantage that the user cannot help but walking on the spike elements continuously regardless of the road conditions after he puts the crampons on his mounting climbing shoes, since the movable spike elements for preventing slippage are integrated with the main plate and simply bent downward.

Therefore, the user has to walk on soils or rocks any other than the icy or snowy roads while the spike elements are protruded toward the ground, which causes difficulties in the user's mountain climbing a lot.

The difficulties are resulted from the structure of the movable spike elements protruded downward and integrated with the main plate. If the user walks for a long time with the crampons as above, fatigue of the user becomes increased and the user may his ankle sprained. Conclusionally, the user can not walk any more.

In order to resolve the above problems, the user separates the crampons from his mountain climbing shoes for non-icy roads or rocky roads. In this case, the conventional crampons have still problems that the separation of the crampons from the mountain climbing shoes takes times and inevitably causes inconvenience to other people in his group by the delay caused by the separation of the crampons.

To the contrary, if the user walks on the crampons on the non-icy or rocky roads, safe contact with respect to the ground can not be realized by the movable spike elements and dangerous situations such as falling may happen.

SUMMARY OF THE INVENTION

Therefore, the present invention is derived to resolve the above and any other disadvantages of the prior art.

According to the present invention, there is an object to provide a crampon for resolving the convenience and improving safety in user's walking simultaneously.

The present invention has another object to provide a crampon having movable spike elements convertible in position according to road conditions in mountain climbing for improving the walking convenience and safety.

The present invention has a further object to provide a crampon having movable spike elements for rotating according to configurations and conditions of a mountain road and fixable in simple manipulation for improving the convenience of use.

The present invention has a still another object to provide a crampon distinguished from others for increasing competitive power thereof, thereby yielding high profits.

In order to achieve the above objects, according to the present invention, there is provided a crampon including a binding bend, a main plate to be mounted to a sole of a climbing shoe and having side plates formed with connection holes for binding the binding bend on both sides, supporting shafts axially fixed to the side plates of the main plate outward, movable spike elements axially coupled with the supporting shafts rotatively and provided with blade-shaped spike pieces, pins fitted into the supporting shafts perpendicularly to the shafts, and rotating locking levers axially coupled with the pins for rotating with respect to the pins, and having pressing cam surfaces for pressing the movable spike elements by manipulation of user when the movable spike elements are to be converted in position.

Therefore, if the movable spike elements are to be positioned toward the ground or not necessary to put on, positions of the movable spike elements are converted accordingly and the pressing cam surfaces press the spike pieces by manipulating the rotating locking levers, so that the movable spike elements are closely fixed to the side plates to be fixed in position.

Therefore, the positions of the movable spike elements are converted immediately according to the road conditions such as icy roads or rocky roads, so as to providing convenience of walking according to the change of the road conditions.

BRIEF DESCRIPTION OF THE DRAWINGS

The objects, features and advantages of the present invention will be more clearly understood from the following detailed description in conjunction with the accompanying drawings, in which.

DETAILED DESCRIPTION OF THE PREFERRED EMBODIMENTS

Now the preferred embodiments according to the present invention will be described with reference to the accompanying drawings.

Figure 1:
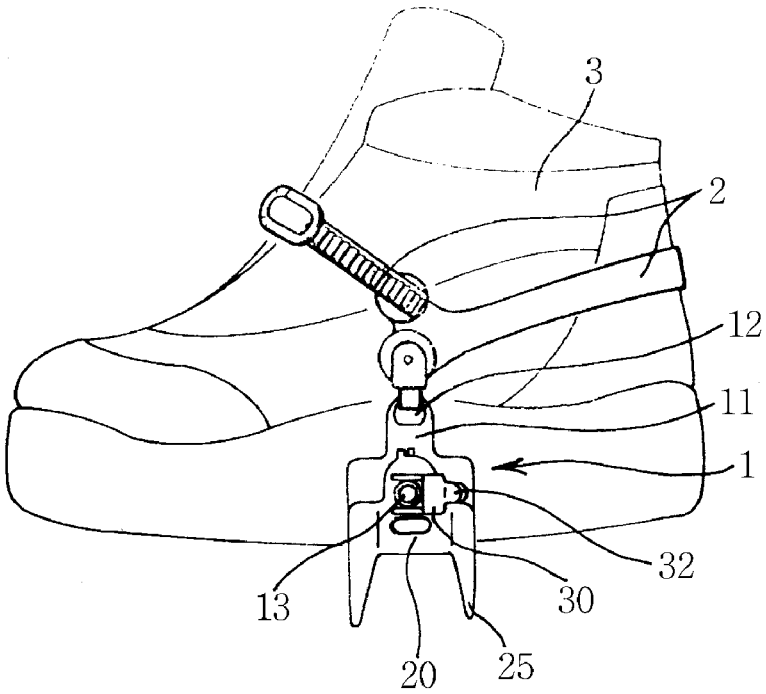
FIG. 1 is a schematic view showing a crampon mounted to a mounting climbing shoe.

FIG. 1 is a schematic front view showing a crampon mounted to a mounting climbing shoe, wherein movable spike elements are rotatively provided to a main plate and the main plate is fixed to a sole of a mountain climbing shoe by a binding band.

Figure 2:
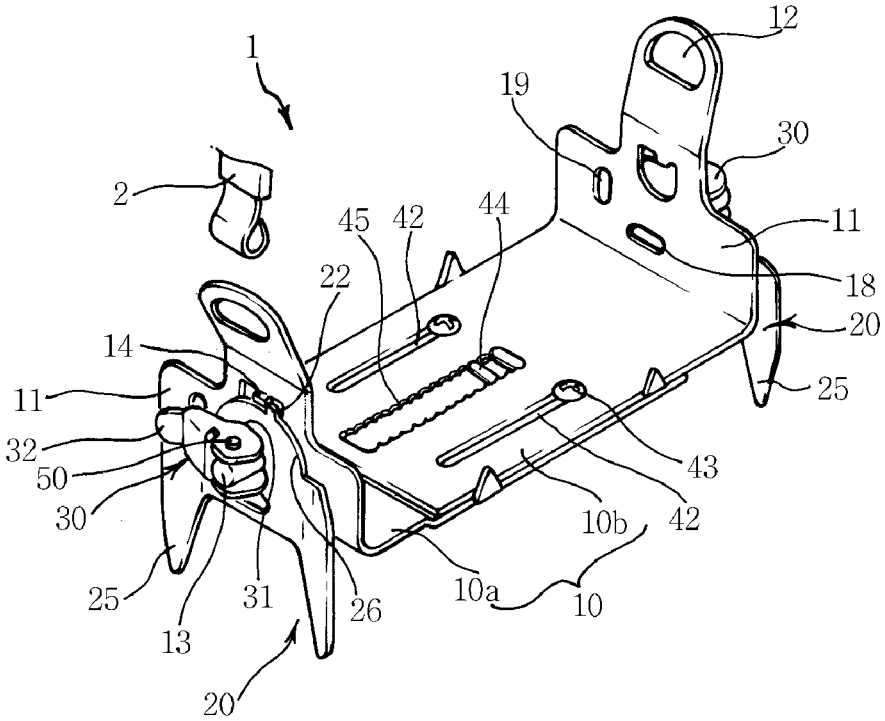
FIG. 2 is a perspective view showing a crampon according to a preferred embodiment of the present invention.

FIG. 2 is a perspective view showing a crampon according to a preferred embodiment of the present invention. In FIG. 2, the movable spike elements are axially coupled outside side plates rotatively, which are provided on both sides of the main plate. The movable spike elements are coupled with rotative locking levers for fixing the rotation state of the spike elements.

Figure 3:
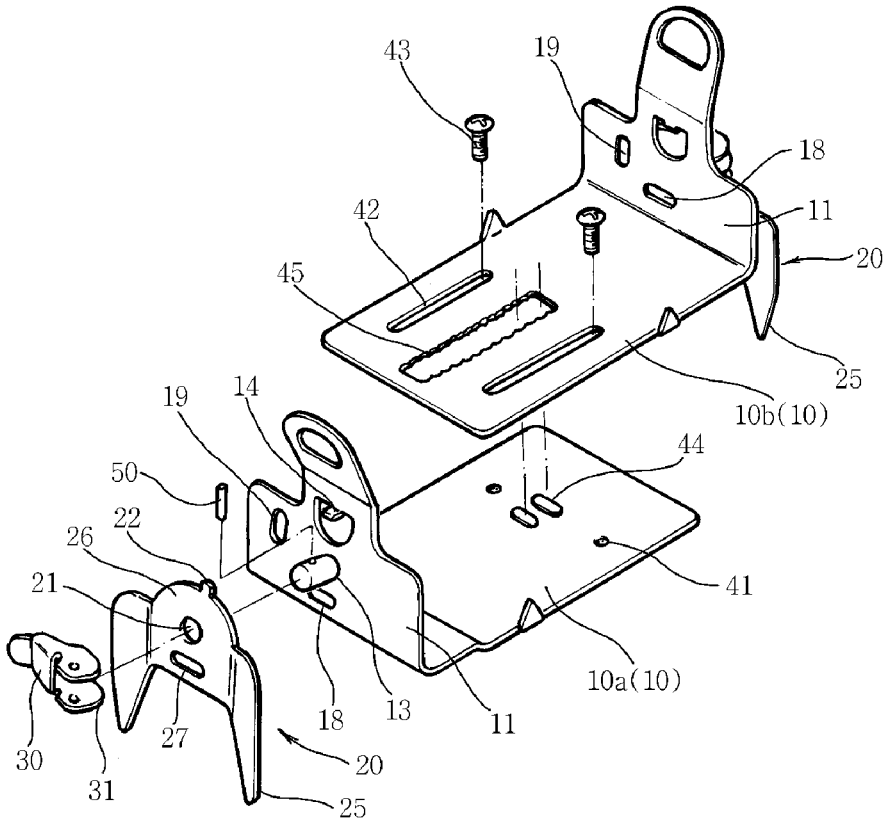
FIG. 3 is a disassembled perspective view of a coupling structure of a main plate and movable spike elements.

FIG. 3 shows a coupling structure of a main plate and movable spike elements in a disassembled perspective view.

Figure 4:
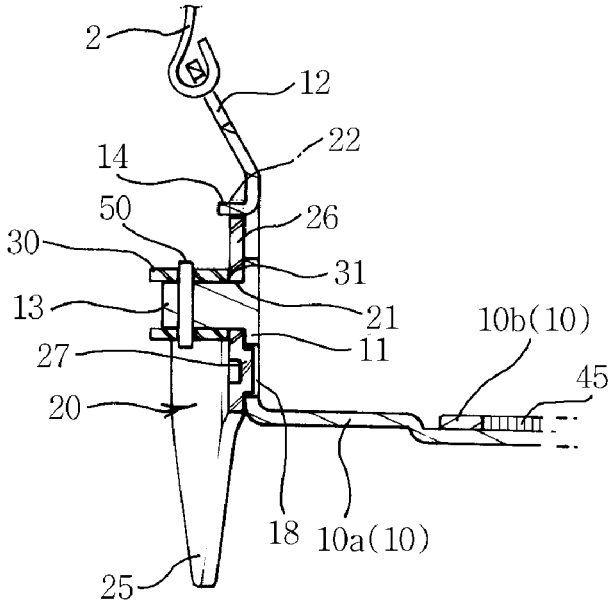
FIG. 4 is a partially expanded cross-sectional view showing the coupling state of the main plate and the movable spike elements.

FIG. 4 is a partially expanded cross-sectional view showing a coupling state between the main plate and the movable spike elements. In FIG. 4, the movable spike elements are coupled with supporting shafts, which are protruded from the side plates outward, and the rotative locking levers fix the movable spike elements.

Figure 5:
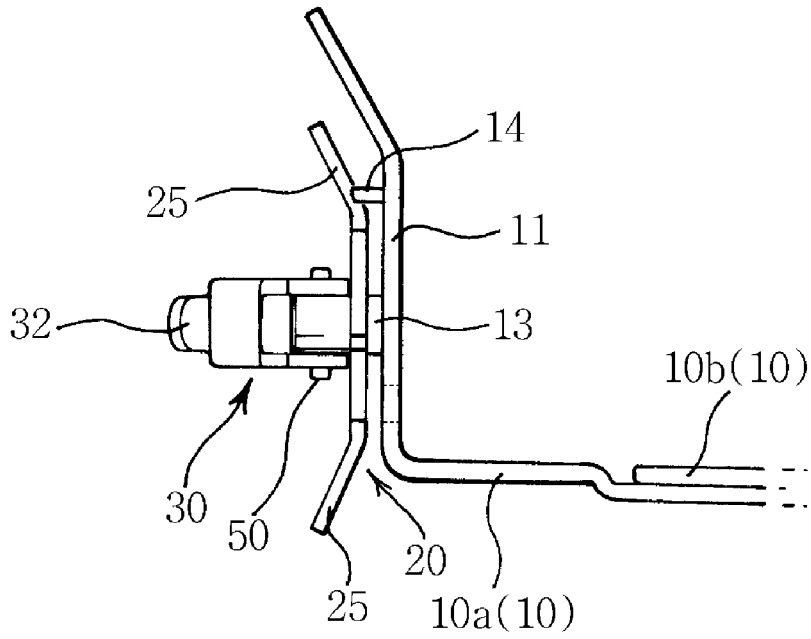
FIG. 5 is a partially expanded view showing an operation state of a rotating locking lever for separating the movable spike element.

FIG. 5 is a partially expanded view showing an operation state of the rotating locking levers for separating the movable spike elements. In FIG. 5, the rotative locking levers release the fixed states of the movable spike elements for rotating the movable spike elements with respect to the supporting shafts and the movable spike elements are separated from the side plates by a predetermined distance.

Figure 6:
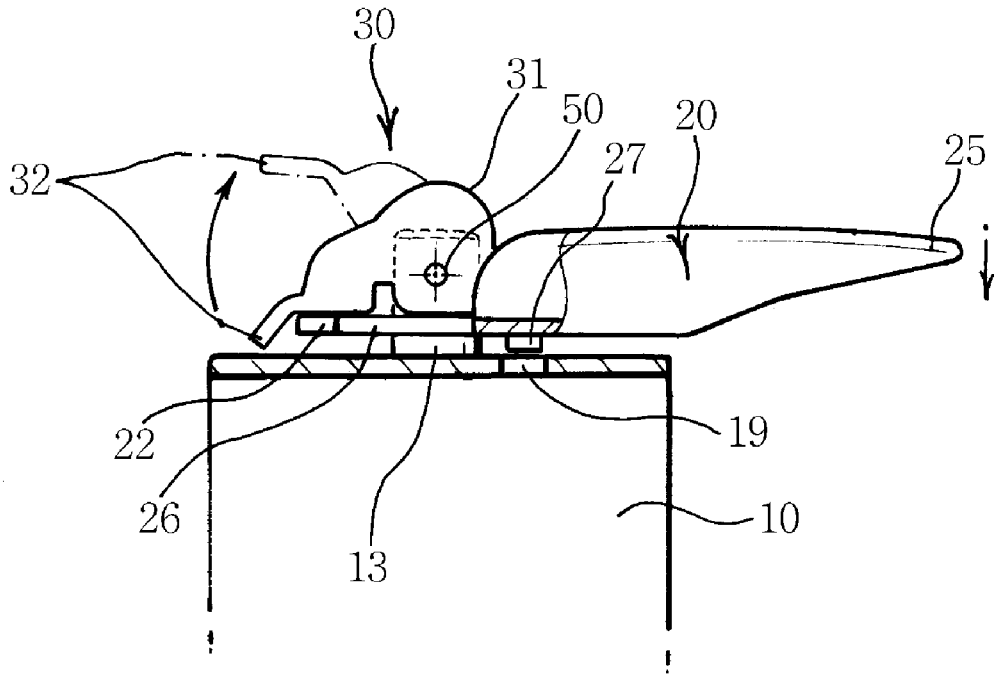
FIG. 6 is a partially expanded plane view showing an operation state of the rotating locking lever for fixing the movable spike element.
Figure 7:
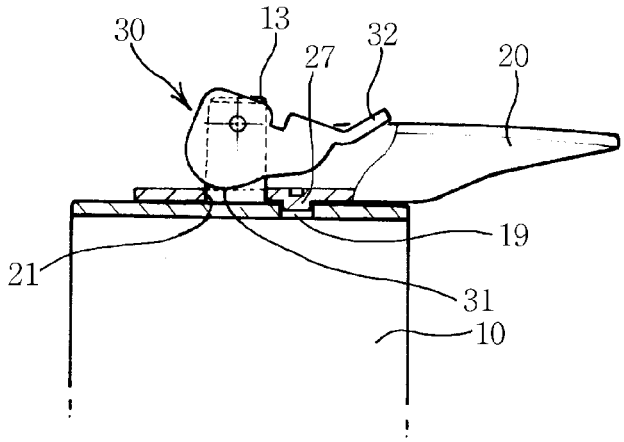
FIG. 7 is a partially expanded plane view for showing the movable spike element fixed by the rotating locking lever.

FIG. 6 and FIG. 7 are partially expanded plane views respectively showing an operation state of the rotating locking levers for fixing the movable spike elements. In FIG. 6 and FIG. 7, the movable spike elements separated from the side plates for rotating with respect to the supporting shafts are in close contact with the side plates to be fixed to the side plates by pressing cam surfaces, which press the movable spike elements against the side plates by reciprocation of the rotative locking levers.

Figure 8:
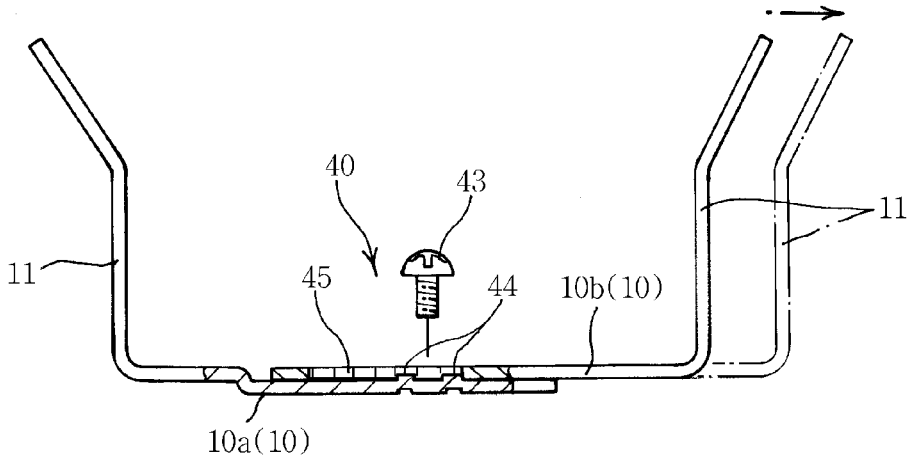
FIG. 8 is a partially taken cross-sectional view showing the main plate, of which a length is controlled by width control elements.

FIG. 8 is a partially taken cross-sectional view showing the main plates, of which a length is controlled by width control elements. In FIG. 8, the main plate have a fixing plate and a moving plate separated from each other, and the fixing plate and the moving plate are overlapped with each other to control a length of the main plate by means of the width control elements.

As shown in FIG. 1 and FIG. 2, the crampon 1 according to the present invention, may be put on the mountain climbing shoe for not only slippery icy roads but also on normal roads by converting the positions of the spike pieces in a short time, thereby improving walking convenience and safety simultaneously.

The crampon 1 is put on the mountain climbing shoe 3 and coupled with the mountain climbing shoe by binding a binding band 2 after positioning a main plate 10 under a sole of the mountain climbing shoe 3.

The main plate 10 is integrally formed with side plates 11 by folding both sides of the main plate upward for supporting the mountain climbing shoe 3.

The side plates are formed with connection holes 12 at end parts thereof to be penetrated by the binding band 2, so that the binding band 2 couples the main plate to an upper part and a rear part of the mountain climbing shoe 3 for preventing any movement between the mountain climbing shoe 3 and the crampon 1.

Therefore, the main plate 10 is kept in a stably fixed state with respect to the mountain climbing shoe 3 by the binding band 2 coupled with the upper part and the heal part of the mountain climbing shoe 3, when the binding band 2 is coupled via the connection holes 12 to put on the main plate 10 under the mountain climbing shoe 3.

As the main plate 10 is coupled with the sole of the mountain climbing shoe 3 by the binding band 2 as above, a user may walk on an icy road of a mountain without slippage by the movable spike elements 20 provided outside the side plates 11.

The movable spike elements 20 are mounted outside the both side plates 11 for free rotation, and rotative locking levers 30 mounted outside the movable spike elements 20 press and fix the movable spike elements 20 not to move from positions of the movable spike elements 30.

As shown in FIG. 4 and FIG. 5, supporting shafts 13 are axially fixed to the side plates 11 outward, wherein axial holes 21 of the movable spike elements 20 are fitted with the supporting shafts 11 somewhat loosely for free rotation of the movable spike elements 20.

The movable spike elements 20 are formed of a metal material of high strength, and have sharp spike pieces 25 integrally molded on both sides and circular plate parts 26 in a semicircular shape integrally formed at the opposite side of the spike pieces.

The circular plate parts 26 have position determining protrusions 27 protruded toward the side plates 11. The side plates 11 have vertical position determining holes 18 and horizontal position determining holes 19 with an angle of 90° approximately therebetween, so that the vertical position determining holes and the horizontal position determining holes respectively receive the position determining protrusions 27 when the spike pieces 25 stand vertically with respect to the ground or lay down horizontally with respect to the ground.

The circular plate parts 26 of the movable spike elements 20 have holding protrusions 22 protruded therefrom, and the side plates 11 have stoppers 14 protruded outward for capturing the holding protrusions 22 of the circular plate parts to restrain rotation positions of the movable spike elements 20 at a certain position while allowing the rotation of the movable spike elements 20 in a predetermined range.

The stoppers 14 of the side plates 11 are protruded at positions for preventing further rotation of the movable spike elements 20 when the spikes 25 of the movable spike elements 20 face the ground. At these positions, the holding protrusions 22 of the circular plate parts 24 are held by the stoppers 14 and the rotation positions of the movable spike elements are determined.

Therefore, in order to make the spikes 25 of the movable spike elements 20 face the ground on an icy road during mountain climbing, the movable spike elements 20 are rotated forward by the positions where the holding protrusions 22 are held by the stoppers 14 without passing beyond the stoppers 14.

In this case, the position determining protrusions 27 are in accordance with the vertical position determining holes 18 of the side plates 11 below the supporting shafts 13. The position determining protrusions 28 are fitted in the vertical position determining holes 18 by pressing the movable spike elements 20 with the rotative locking levers 30.

The rotative locking levers 30 keep the pressing states for the movable spike elements 20 to prevent the position determining protrusions 27 from escaping out of the vertical position determining holes 18.

When the user walks on the icy road while the spikes 25 of the movable spike elements 20 face the ground as above, the rotation position of the movable spike elements 20 is controlled by the engagement between the stoppers 14 and the holding protrusions 22.

On the other hand, if the user walks on soils or rocks without contact between the spike pieces 25 and the ground by making the spikes 25 position horizontally, shoulder parts formed on both sides of the movable spike elements 20 are captured by the stoppers 14.

As described above, the position of the movable spike elements 20 are precisely controlled vertically or horizontally according to the road conditions, so that it is not necessary for the user to manipulate rotation angles of the spike pieces 25 annoyingly, thereby minimizing the inconvenience of use.

On the normal road any other than the icy or snowy roads, the user may walk comfortably by immediately converting the positions of the movable spike elements 20.

In this case, the pressing positions of the rotative locking levers 30 are released for allowing the deviation of the position determining protrusions 27 from the vertical position determining holes 18. Then, the user may rotate the movable spike elements 25 by hand by about 90° to convert the position of the spike pieces 25 horizontally with respect to the ground.

Therefore, the position determining protrusions 27 protruded from the movable spike elements 20 become rotate in association with the movable spike elements 20 and positioned to the horizontal position determining holes 19 beside the supporting shafts 13. Then, the position determining protrusions 27 are fitted into the horizontal position determining holes 19 by pressing the rotative locking levers 30.

The rotative locking levers 30 press the position determining protrusions 27 not to escape out of the horizontal position determining holes 19.

The rotative locking levers 30 serve to prevent rotation of the movable spike elements 20, which is in close contact with the side plates 11, after the movable spike elements 20 are controlled in position with respect to the supporting shafts 13. The rotative locking levers 30 are positioned to ends of the supporting shafts 13 and pins 50 are inserted into the supporting shafts 13 perpendicularly with respect to the supporting shafts 1, so that the rotative locking levers 30 may freely rotate in a direction perpendicular to the supporting shafts 13.

The rotative locking levers 30 are formed with the pressing cam surfaces 31, which are eccentric with respect to the pins 50. If the rotative locking levers 30 are rotated after the movable spike elements 20 are rotated to desired positions, the pressing cam surfaces 31 press the movable spike elements 20 forcedly.

Therefore, the movable spike elements 20 are pressed against the side plates 11 by the pressing cam surfaces 31 of the rotative locking levers 30, and prevent the movement of the movable spike elements 20 or the deviation of the position determining protrusions 27 out of the vertical position determining holes 18 or the horizontal position determining holes 19.

A handle part 32 is protruded from a side of each of the rotative locking levers 30 for the user to easily manipulate the rotative locking levers 30 to reciprocate.

If the user converts the position of the rotative locking levers 30 by the handle parts 32 while the movable spike elements 20 are converted in their positions with respect to the supporting shafts 13, as shown in FIG. 6 and FIG. 7, the movable spike elements 20 are pressed to be fixed outside the side plates 11 or released from their pressed and fixed states.

Now, the method for fixing the movable spike elements 20 outside the side plates 11 by manipulating the rotative locking levers 30 will be described in more detail with reference to the accompanying drawings.

In order to rotate the movable spike elements 20 according to the road conditions, the rotative locking levers 30 are manipulated to release the locking states of the movable spike elements 20 with respect to the side plates 11 to allow the movable spike elements 20 to rotate with respect to the supporting shafts 13 as shown by a solid line.

At this time, the movable spike elements 20 are not pressed by the pressing cam surfaces 31 of the rotative locking levers 30, so that the position determining protrusions 27 of the movable spike elements 20 are deviated from the vertical position determining holes 18 or the horizontal position determining holes 19. Therefore, a space is secured between the rotative locking levers 30 and the side plates 11 for free rotation of the movable spike elements 20.

According to the road surface conditions, the movable spike elements 20 are rotated to make the spike pieces 25 face the ground on the icy or snowy road or to make the spike pieces 25 horizontal to the ground on the normal road. Then, the rotative locking levers 30 are manipulated for pressing the movable spike elements 20 against the side plates 11 by the pressing cam surfaces 31 to fix the movable spike elements 20 at the rotated positions, as shown in FIG. 7.

It is convenient for the user to rotate the movable spike elements 20 since the fixed states of the movable spike elements 20 are kept at their rotated positions by using the rotative locking levers 30 according to the road conditions of the user.

In the meantime, the main plate 10 may be easily put on the sole of the mountain climbing shoe 3 by the binding band 2 regardless of size of the mountain climbing shoe 3 since width of the main plate 10 between the side plates 11 is controlled by the width controlling elements 40.

The crampon of the present invention may be put on any mountain climbing shoes in the optimum state according to body conditions of a user or types of the mountain climbing shoes by width controlling elements 40.

As shown in FIG. 8, the width controlling elements 40 make the fixing plate 10*a* and the moving plate 10*b* of the main plate 10 overlapped partially, wherein the fixing plate 10*a* and the moving plate 10*b* are prepared separately.

The fixing plate 10*a* is formed with a screw hole 41 and the moving plate 10*b* is formed with a guide hole 42 elongated in the lengthwise direction, wherein a coupling bolt 43 penetrates the guide hole 42 and screw-coupled in the screw hole 41.

In order to control the width of the main plate 10 according to a width of a mountain climbing shoe, the coupling bolt 43 is released and a width between the fixing plate 10*a* and the moving plate 10*b* is controlled properly. After that, the coupling bolt 43 is fastened in the screw hole 41 to prevent the fixing plate 10*a* and the moving plate 10*b* from moving unintentionally.

A width of the crampon 1 of the present invention is controllable according to various sizes of mountain climbing shoes or different body size of users as described above.

The fixing plate 10*a* is formed with a concave and convex portion 44 at a top surface and the moving plate 10*b* is formed with a continuous ratchet groove 45 to be coupled with the concave and convex portion 44 of the fixing plate 10*a* for preventing movement, so that the fixing plate 10*a* and the moving plate 10*b* are prevented from moving in the fastened state of the coupling bolt 43 in spite of any external shock or repetitive walking. The fixing plate 10*a* is preferably formed with 1 to 3 concave and convex portions in an approximately elongated oval shape, and the moving plate 10*b* is formed with the ratchet grooves 45 continuously in an approximately semicircular shape. Therefore, the concave and convex portions 44 are stably fitted in the ratchet grooves 45 at positions for the side plates 11 to stably contact side parts of the mountain climbing shoe when the user puts on the crampon on his mountain climbing shoe.

The width between the fixing plate 10*a* and the moving plate 10*b* is not unintentionally changed by long term walking since such the coupling bolts 43 prevent the concave and convex portions 44 from being escaped out of the ratchet grooves 45.

Therefore, the crampon is coupled with the mountain climbing shoe comfortably with walking convenience and safety by the binding band 2 after fine length control carried out by the concave and convex portions 44 and the ratchet grooves 45, which serve as the width controlling elements 40 for the fine control of the width of the main plate 10 according to the size of the mountain climbing shoes 3.

Therefore, the crampon of the present invention may be used properly and conveniently according to the mountain climbing or walking conditions of the user.

According to the crampon of the present invention, the movable spike elements may be rotated toward the ground or in parallel to the ground according to the road surface conditions and locked by the rotative locking levers, thereby improving the walking convenience and safety simultaneously.

Further, the crampon may be controlled in the width of the main plate according to the size of the mountain climbing shoe, thereby providing the convenience of wear.

Therefore, the crampon of the present invention may be distinguished from others with high competitive power, thereby yielding high profits.

Although the foregoing description has been made with reference to the preferred embodiments, it is to be understood that changes and modifications of the present invention may be made by the ordinary skilled in the art without departing from the spirit and scope of the present invention and appended claims.

What is claimed is:

1. A crampon, comprising:

a binding bend;

a main plate to be mounted to a sole of a climbing shoe and having side plates formed with connection holes for binding the binding bend on both sides:

supporting shafts axially fixed to the side plates of the main plate outward;

movable spike elements axially coupled with the supporting shafts rotatively and provided with blade-shaped spike pieces;

pins fitted into the supporting shafts perpendicularly to the shafts; and rotating locking levers axially coupled with the pins for rotating with respect to the pins, and having pressing cam surfaces for pressing the movable spike elements by manipulation of a user for converting positions of the movable spike elements;

wherein the movable spike elements have circular plate parts formed with position determining protrusions protruded toward the side plates, and the side plates have vertical position determining holes and horizontal position determining holes for receiving the position determining protrusions, wherein the vertical position determining holes are at positions of the spike pieces when the movable spike elements are standing vertically on the ground surface, and the horizontal position determining holes are at positions of the spike pieces when the movable spike elements are laying down horizontally on the ground surface.

2. The crampon as claimed in claim 1, wherein the main plate includes a fixing plate and a movable plate molded separately from each other, and the fixing plate and the movable plate are coupled with each other by width controlling elements, which control an overlapping length between the fixing plate and the movable plate, wherein the width controlling elements are screw holes formed in the fixing plate, guide holes formed in the movable plates in the lengthwise direction, and coupling bolts screw-coupled in the screw holes by penetrating the guide holes.

3. The crampon as claimed in claim 1, wherein the circular plate parts of the movable spike elements are formed with holding protrusions, and the side plates are formed with stoppers protruded outward, so that the stoppers control rotation positions of the circular plate parts by capturing the holding protrusions while allowing rotation of the circular plate parts.

4. The crampon as claimed in claim 2, wherein the fixing plate is formed with concave and convex portions at a top surface and the movable plate is formed with ratchet grooves continuously, so that the concave and convex portions of the fixing plate are fitted into the ratchet grooves of the movable plate.

* * * * *